US006774369B2

(12) United States Patent
Haufe

(10) Patent No.: US 6,774,369 B2
(45) Date of Patent: Aug. 10, 2004

(54) DETECTION DEVICE

(75) Inventor: Andre Haufe, Berlin (DE)

(73) Assignee: Iris-GmbH Infrared & Intelligent Sensors, Berlin (DE)

( * ) Notice: Subject to any disclaimer, the term of this patent is extended or adjusted under 35 U.S.C. 154(b) by 107 days.

(21) Appl. No.: 10/070,871

(22) PCT Filed: Jul. 12, 2001

(86) PCT No.: PCT/EP01/08067

§ 371 (c)(1),
(2), (4) Date: Mar. 12, 2002

(87) PCT Pub. No.: WO02/07106

PCT Pub. Date: Jan. 24, 2002

(65) Prior Publication Data

US 2002/0148965 A1 Oct. 17, 2002

(30) Foreign Application Priority Data

Jul. 13, 2000 (DE) ..... 100 34 976

(51) Int. Cl.[7] ..... G07C 9/00
(52) U.S. Cl. ..... 250/342; 250/338.1
(58) Field of Search ..... 250/342, 353, 250/338.1, 340, 565, 567, 542

(56) References Cited

U.S. PATENT DOCUMENTS 4,769,697 A * 9/1988 Gilley et al. ..... 358/84
5,101,194 A * 3/1992 Sheffer ..... 340/567
5,187,688 A 2/1993 Saruta
5,255,301 A 10/1993 Nakamura et al.
5,499,016 A * 3/1996 Pantus ..... 340/555
5,555,512 A 9/1996 Imai et al.
6,037,594 A * 3/2000 Claytor et al. ..... 250/353
6,211,522 B1 * 4/2001 Kotlicki et al. ..... 250/353
6,348,863 B1 * 2/2002 Krubiner et al. ..... 340/567

FOREIGN PATENT DOCUMENTS

| | | |
|---|---|---|
| DE | 42 20 508 A1 | 12/1993 |
| DE | 197 32 153 A1 | 2/1998 |
| DE | 197 21 741 A1 | 11/1998 |
| EP | 0 515 635 B1 | 3/1996 |
| WO | WO 01/18697 A1 | 3/2001 |

* cited by examiner

*Primary Examiner*—Constantine Hannaher
*Assistant Examiner*—Otilia Gabor
(74) *Attorney, Agent, or Firm*—Hahn Loeser & Parks, LLP; Robert J. Clark

(57) ABSTRACT

A detection device for detecting persons or objects and the direction of movement thereof comprising a radiation sensor arrangement for detecting electromagnetic radiation of the wavelength of visible and/or invisible light which is reflected or emitted by a person or an object, and an evaluation unit which is connected to the sensor arrangement, wherein the evaluation unit is adapted to form a variation signal which corresponds to the time variation of the radiation detected by the radiation sensor arrangement and is connected to a store which is adapted to store at least a portion of the variation signal and a characteristic parameter associated with the variation signal.

53 Claims, 2 Drawing Sheets

DETECTION DEVICE

The invention concerns a detection device for detecting persons or objects and the direction of movement thereof, comprising a sensor arrangement for detecting electromagnetic radiation with the wavelength of visible and/or invisible light, which is reflected or emitted by a person or an object, and an evaluation unit which is connected to the sensor arrangement and adapted to derive a signal from the radiation detected by the radiation sensor arrangement and to deliver a detection signal for as far as possible each object or person detected by the radiation sensor arrangement. In particular the invention concerns a counting device for persons, which is connected to a corresponding detection device.

BACKGROUND OF THE ART

An area of use of detection devices of that kind is the detection of persons who pass through an entry or exit region of a means of transport in order to count the passengers who pass into or leave the means of transport. DE 42 20 508 and EP 0 515 635 each disclose detection devices which, in relation to the intended direction of movement of the passengers, have sensor elements which are arranged one after the other, and which ascertain the direction of movement of detected persons by correlation of the radiation detected by the sensor elements. Detection devices of that kind are thus capable of ascertaining not only the presence of an object or a person, as in the case of a simple light barrier arrangement, but also the direction of movement of the object or person. A problem here however is that of reliably detecting persons who are not moving with a specific destination in mind but who for example are standing in the entrance region of a bus, or distinguishing the signals which originate from various people who are in great mutual proximity.

One approach to resolving the last-mentioned problem is set forth in DE 197 21 741. It is proposed therein that a continuous spacing signal for detected objects should be formed and the spacing function obtained in that way should be compared to predetermined or stored spacing characteristics of known objects in order in that way to obtain information about the number, movement or nature of the objects. In accordance with DE 197 21 741 that is effected by means of an active signal generator/detector arrangement. Active means that the detector records the radiation which is delivered by the signal generator and reflected by the object or the person.

It is known from DE 197 32 153 for two images of a person, which are recorded from different vantage points, to be associated with each other on the basis of characteristic image features, in order in that way to obtain spatial information.

SUMMARY OF THE INVENTION

An object of the present invention is to provide a detection device which in a simple manner permits even more accurate object or person detection or counting.

In accordance with the invention that object is attained by a detection device of the kind set forth in the opening part of this specification, which includes individualising means which are connected to the evaluation unit and which are adapted to produce information individualising an object or a person, and which is connected to a store adapted to store at least a portion of the variation signal and the information individualising the object or the person, as a characteristic parameter, in association with the variation signal. In that respect the parameter can be derived directly from the variation signal or can be derived from the variation signal and an additional signal which can be obtained by an additional passive sensor and/or derived from an active radiation source. The parameter can also be one-dimensional or multi-dimensional, that is to say for example a matrix or a vector with a plurality of values which in particular individualise a person.

The invention is based on the idea of combining in per se known manner a variation signal which is to be produced passively with at least one characteristic parameter so as to afford an at least two-dimensional signal or parameter matrix which combines items of information about the time variation of the radiation detected by the sensor arrangement with additional items of information. Such an arrangement makes it possible to derive a movement signal by signal correlation from the variation signal, in a manner known per se from DE 42 20 508 or EP 0 515 635, and to associate that movement signal with an individual object or an individual person as reliably as possible by means of the characteristic parameter or parameters. Preferably the characteristic parameter describes a person-individual parameter such as hair color, height, stature, etc.

The additional characteristic parameter can admittedly be determined solely from the signal morphology in the case of a passive arrangement. However a further preferred underlying notion of the invention is for the detection device to be provided with additional means for determining the characteristic parameter. Among the large number of additional means which can be envisaged, two alternatives have proven themselves to be particularly appropriate, in an unforeseeable fashion, namely a radiation source for implementing an active arrangement of the detection device, or alternatively or additionally an additional sensor for detecting a further signal besides radiation, for example an acoustic signal or a scent signal.

In the case of an active arrangement with a radiation source the additional parameter can be ascertained by evaluation of the radiation reflected by an object or a person, in relation to the radiation emitted by the radiation source. In that way, it is possible to obtain information about the transit time of a signal from the radiation source by way of a reflecting person to the sensor arrangement or the degree of reflection.

The preferred frequency or wavelength range of the electromagnetic radiation, for the detection of which the sensor arrangement is adapted, is the range of greater than 1400 nm. In the case of an active arrangement with a radiation source, that wavelength range also applies in regard to the radiation source. It has been found that, in that wavelength range, it is possible to achieve both an advantageous signal-noise ratio and also a high degree of sight safety. In particular a radiation output in that wavelength range can be more than 1000 times greater than for example in the region of 1050 nm, without that involving any danger to health.

In principle, preferred embodiments of the detection device are those which are adapted to be arranged in entrance and exit openings such as for example doors of vehicles or rooms.

A preferred area of use of the detection device is counting passengers for example in buses. In particular for that area of use, the detection device is preferably connected to a locating device such as for example a GPS receiver. In that way the numbers of passengers ascertained by the detection device by means of a counting unit for the entering and exiting passengers can be associated with given route sections or stops of a bus. Together with an optional evaluation unit, integrated vehicle management is thus possible. That can be used for an entire vehicle park if the detection devices and locating devices of different vehicles are adapted to be connected to a central station by way of radio.

In a preferred arrangement, the radiation source is arranged for example in the entrance region of a vehicle, in such a way that the radiation from the radiation source impinges from above on the person passing through the entrance region and is reflected from the top of the head of the person in such a way that the height of a person can be determined from the transit time of the signal. The characteristic parameter to be stored then corresponds to the height of the person. The variation signal which is recorded synchronously can be specifically associated with a person of the corresponding height, by means of the characteristic parameter. As most people differ in height at least within certain limits, it is possible in that way to provide for a substantially person-individual association of variation signals, so that even those variation signals which result from the radiation from two people who are at a great proximity from each other are to be associated as coming from two different people.

An essential difference in relation to the device disclosed in DE 197 21 741 is that for example in the case of the operation of determining the height of a person, for forming the characteristic parameter, it is not the spacing function—that is to say the variation in spacing—that is stored and compared to other spacing functions, but only the minimum of the spacing between the radiation source and the sensor arrangement on the one hand and the top of the head of a person on the other hand.

Fundamentally, both the systems known from DE 42 20 508 and EP 0 515 635 and also that known from DE 197 21 741 are based solely on the correlation of two signal variations or functions. In the case of the system proposed herein the characteristic parameter is not derived from a comparison or a correlation of functions among signal variations, but from one signal alone. That signal can originate for example from an infrasound sensor for detection of heart sounds and thus the heart rate, or from the arrangement, already described above, for detection of the height of a person, or also a sensor matrix arrangement on to which is projected an image of the persons passing through the entrance region, so that a parameter which characterises the contour of the persons can be obtained from the image.

The sensor matrix arrangement can be connected to a radiation source of the above-described kind to constitute an active sensor so that it is possible to record a three-dimensional height contour of a detected person as a characteristic parameter.

Preferably at least one suitable sensor is provided in each case for recording such or other person-individualising signals. That sensor is preferably switched on when the variation signal shows that the detected person is just at the greatest proximity in relation to the sensor. Alternatively the sensor remains continuously switched on and only that portion of the signal originating from the sensor, which was recorded at the time of greatest approach to the sensor, is evaluated. For that purpose the detection device preferably includes suitable locating or distance-determining means and a selection unit which is connected thereto and which selects the appropriate signal portion originating from the sensor, for further processing.

In subtly differentiated or sophisticated configurations of the invention a plurality of characteristic parameters or parameter variations can be simultaneously obtained and combined together in order to permit still more accurate differentiation of the items of information obtained and thus still more specific individualisation of the detected persons.

Further preferred embodiments are set forth in the appendant claims.

These include in particular detection devices with an additional sensor for person-individual features such as height, build, hair color, heart sounds or scent of a person or an object.

The invention will now be described in greater detail by means of an embodiment.

DETAILED DESCRIPTION OF THE INVENTION

Figure 1:
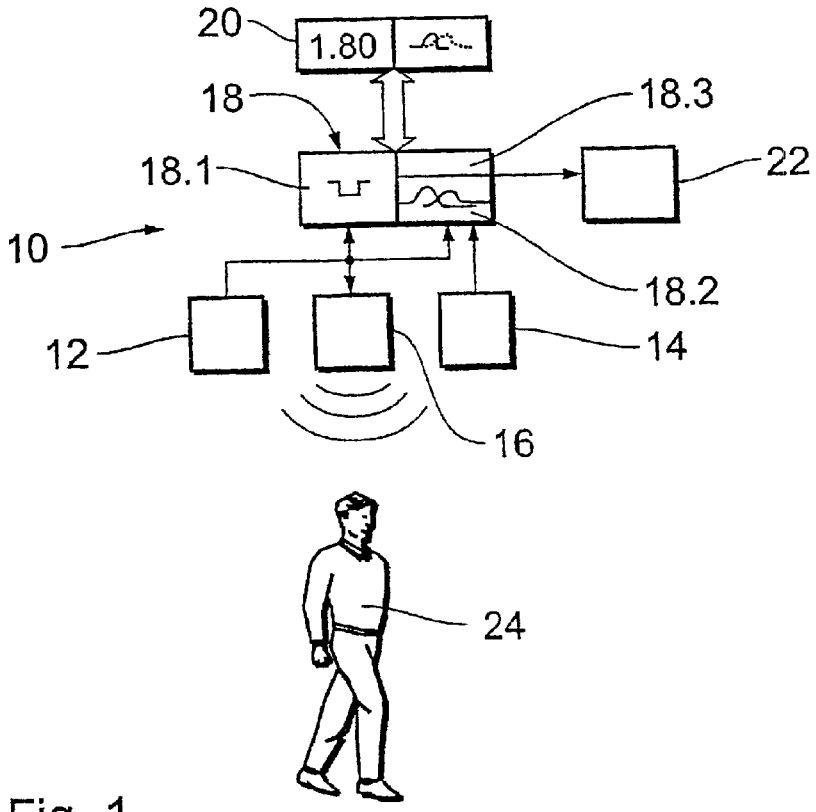
FIG. 1 shows a first variant of a detection device with an active sensor unit.

The detection device 10 shown in FIG. 1 has two infrared sensors 12 and 14 which for example can be fixed above the entrance region of a bus arranged one behind the other lengthwise in the entrance or exit direction. An infrared radiation source 16 is disposed between the two sensors 12 and 14. The sensors 12 and 14 and the radiation source 16 are respectively connected to an evaluation unit 18. The evaluation unit 18 includes three modules, a spacing module 18.1, a correlation module 18.2 and an association module 18.3. The evaluation unit 18 is further connected to a store 20 and a counting unit 22.

The sensor 12 and the radiation source are jointly connected to the spacing module 18.1 of the evaluation unit 18. In the spacing module 18.1, the phase relationship between the radiation emitted by the radiation source 16 and the radiation received by the sensor 12 is ascertained and thus the transit time is determined, which is required by the signal emitted by the radiation source 16 and reflected by an object, for it to be recorded by the sensor 12. Thus, it is possible to ascertain the spacing between the radiation source 16 and the sensor 12 on the one hand and a reflecting surface on the other hand. Instead of evaluating the transit time, it is possible for the spacing in relation to a reflecting object to be also determined directly, by way of the wavelength of the signal emitted by the radiation source 16 and the phase relationship between the emitted and received radiation. The technologies required for that purpose are basically known. As the radiation source 16 and the sensor 12 are arranged perpendicularly above the entrance for example of a bus, and the distance in relation to the ground is known, it is possible to arrive at a conclusion about the height of a person passing through the entrance region, from the minimum of a sequence of successive spacing measurements. That minimum is stored as the height of a person in the store 20 and represents a parameter which is characteristic in respect of the person.

Simultaneously with the procedure for determining height, the radiation signals which are reflected or emitted by a person are recorded with the two sensors 12 and 14 and correlated with each other. By virtue of the movement of a person 24 who for example is entering the bus, the two radiation sensors 12 and 14 pick up similar variation signals which are time-shifted relative to each other. The direction of movement and the speed of an entering or exiting person 24 can be ascertained from the spacing of the two sensors 12 and 14 and the displacement in respect of time between the variation signals recorded by the sensors.

In that way the following items of information are obtained:

If the signal recorded by the sensor 12 changes in relation to the signal recorded by the sensor 14 or vice-versa, that is an indication that there is a reflecting or radiating object in the detection region of the sensors 12 and 14. Changes in the radiation background occur synchronously at both sensors 12 and 14 and can therefore be masked out. If evaluation of the variation signals obtained in that way at the sensors 12 and 14 shows that the two variation signals are in time-displaced relationship or also do not correlate with each other in such a way that the correlation exceeds a given level, the speed of an object can be ascertained from the time displacement of the signals.

Since, as already explained in the opening part of this specification, it is not always the case that all mutually correlating signals are to be associated with one person or a person can also remain standing in the entrance region of a bus so that the variation in the two variation signals recorded by the sensors 12 and 14 changes little, the information ascertained by the correlation module 18.2 can be linked to that from the spacing module 18.1. A person who is standing in the entrance region of a bus is to be easily identified, from the point of view of the spacing module 18.1. The store 20 stores the information in respect of height in relation to a person, in such a way that it is associated with the variation signal emanating from that person. The combination of the two items of information is very highly characteristic in respect of a person and makes it possible to recognise a person not only when entering but also possibly when exiting again.

As a greater degree of individualisation of entering or exiting persons is possible by linking the information in respect of height to that from the comparison of the variation signal information, such persons can also be more accurately counted. Association of the information obtained by means of the spacing module 18.1 with the information obtained by means of the correlation module 18.2, targeted storage of those items of information, and call-up of the stored items of information, are effected by the association module 18.3.

Having regard to the directional information from the correlation module 18.2, it is possible for the association module 18.3 to identify a person as entering or exiting. The counter unit 22 is connected to the association module 18.3 and is designed in such a way that, for each person detected as entering by the association module 18.1, a counter is increased by one, while for each exiting person, it is reduced by one. The counter condition in the counting unit 22 thus gives the number of persons who are for example on a bus. For that purpose the counting unit can be connected to a plurality of evaluation units 18 which are associated with a plurality of entrance regions of a means of transport.

Figure 2:
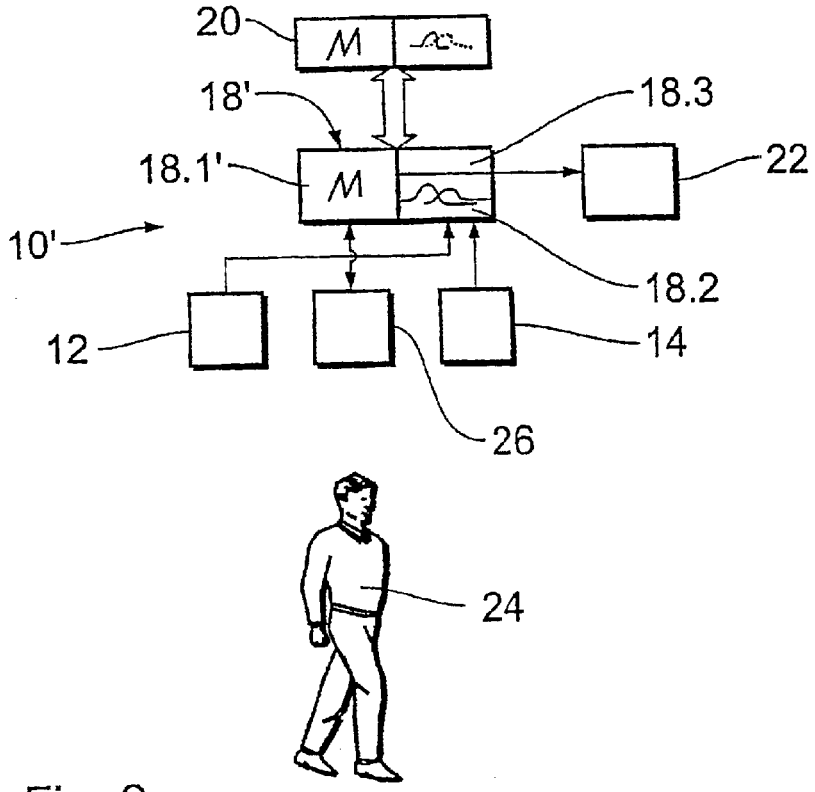
FIG. 2 shows a detection device similar to FIG. 1 with a passive sensor unit and an additional sensor for a person-individual feature.

The detection device 10' in FIG. 2 has a passive sensor unit formed by the sensors 12 and 14, for recording the variation signal. In addition the arrangement has an additional sensor 22 which records a person-individual feature such as for example hair color or heart sounds or the like. Evaluation of the additional signal is effected by an evaluation module 18.1' of the evaluation unit 18'. Association with the variation signal recorded by the sensors 12 and 14 is effected by the association module 18.3, as already described with reference to FIG. 1. The evaluated additional signal is stored in the memory 20, in association with the variation signal.

Figure 3:
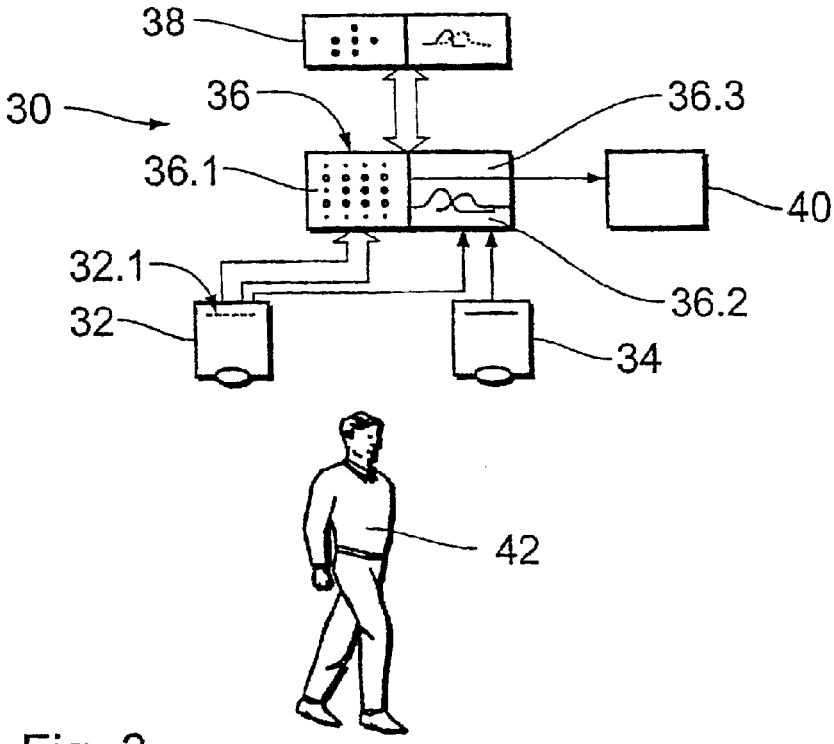
FIG. 3 shows a detection device with a passive sensor matrix for recording a multi-dimensional person-individual feature.

The detection device 30 in FIG. 3 is of a similar design to the detection device 10 shown in FIG. 1. This device also has two infrared sensors 32 and 34, an evaluation unit 36, a store 38 and a counting unit 40. The device does not have an active radiation source like the radiation source 16 in FIG. 1.

Instead, at least the sensor 32 includes a plurality of sensor elements 32.1 in a matrix-like arrangement. The sensor elements 32.1 are disposed at the focus of an imaging apparatus as in a convergent lens 32.2. The radiation emanating from a person 42 is thus projected on to the sensor matrix 32.1 as an image of the person 42.

In that respect, each person affords a substantially individual projection pattern, and this is characteristic for the respective person 42. That projection pattern is passed to an image module 36.1 of the evaluation unit 36. In the image module 36.1, a characteristic pattern is extracted from the projection pattern, as a characteristic parameter, and stored in the store 38.

Variation signals are recorded by means of the sensors 32 and 34, in parallel with the operation of forming the characteristic pattern. In that respect, it is sufficient if the sensor 34 includes only one sensor element and only one sensor element of the sensor matrix 32.1 is used for the variation signal from the sensor 32.

As is already the case in relation to FIG. 1, the two variation signals are correlated -with each other in a correlation module 36.2 of the evaluation unit 36 in order to obtain an item of movement information. That movement information is stored in the memory 38, associated with the corresponding characteristic pattern.

An association module 36.3 of the evaluation unit 36 operates similarly to the association module 18.3 in FIG. 1 and in dependence on the possibly stored output values of the image module 36.1 and the correlation module 36.2, for each entering or exiting person, outputs a signal which serves for actuation of the counting unit 40 and appropriately counts up or down a counter therein.

Figure 4:
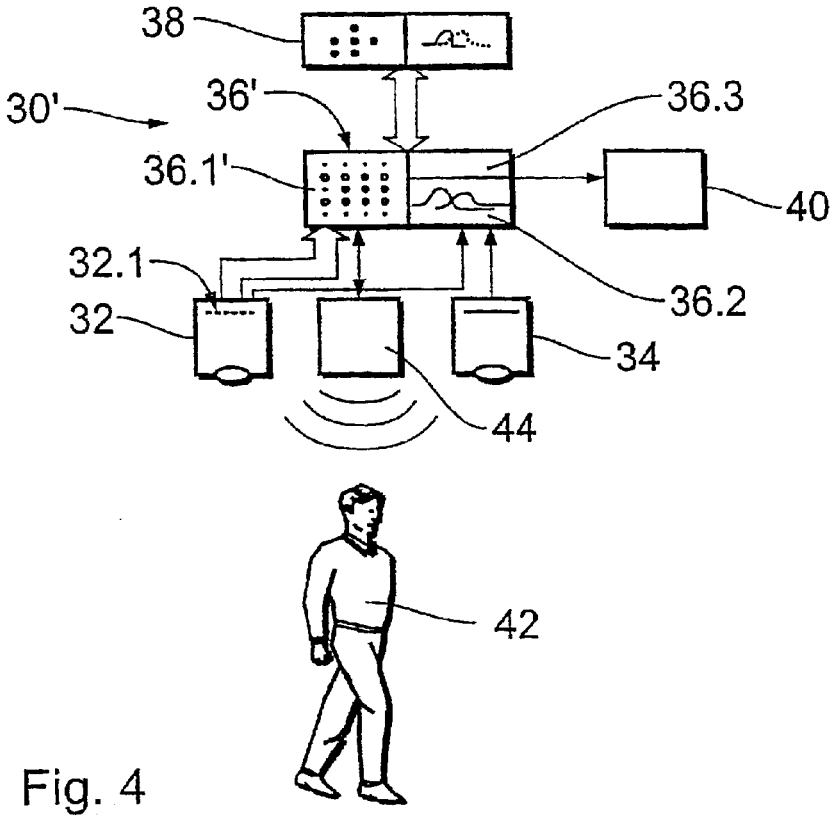
FIG. 4 shows a detection device similar to FIG. 3 with an active sensor matrix for recording a multi-dimensional person-individual feature.

The detection device 30' in FIG. 4 differs from the detection device 30 shown in FIG. 3 essentially in that it includes a radiation source 44 which makes it possible to expand the sensor matrix 32.1 to form an active sensor unit. By means of the radiation source 44 and the sensor matrix 32.1 it is possible to form a three-dimensional contour of an object or a person in the detection region of the sensor matrix 32.1. That is effected by evaluation of the radiation detected by the sensor matrix 32.1, in relation to the radiation emitted by the radiation source 44, in an evaluation module 36.1'. The evaluation module 36.1' is for that purpose connected to the radiation source 44 and the sensor matrix 32.1 and is so designed that a matrix which corresponds to the three-dimensional surface contour of the detected object or the detected person is formed from the radiation which is emitted by the radiation source 44 and reflected by a person or an object and detected by the sensor matrix 32.1. That matrix is stored in association with the variation signal in the store 38 as a characteristic parameter and information individualising the respective person.

By means of matrix comparison, it is possible to recognise a person who enters, when that person later exits. For that purpose, the association module 36.3 is adapted to compare matrices detected when persons enter to such matrices which were detected when persons exit. The entrance and exit direction in that respect arises out of the variation signal. The association module 36.3, for matrix comparison, is also designed for transformation of matrices, in particular for turning matrices, in order to be able to take account of the differing orientation of entering and exiting persons and the resulting alteration in the contour images to be compared.

It is possible to achieve the desired accuracy and individualisation of a detection device by many different variations in the concepts described and claimed.

What is claimed is:

1. A device for counting passengers on a transportation vehicle, said counting device comprising:

a detection device for detecting persons or objects and the direction of movement thereof, comprising:

a radiation sensor arrangement for detecting electromagnetic radiation of the wavelength of visible and/or invisible light, which emanates from the person or object, and an evaluation unit that is connected to the sensor arrangement and that forms a variation signal which corresponds to a time variation of the radiation detected by the radiation sensor arrangement, wherein the detecting device further comprises a means for individualizing that is connected to the evaluation unit and that obtains information individualizing the object or person, and that is connected to a store that stores at least a portion of the variation signal and the information individualizing the object or the person as a characteristic parameter in association with the variation signal such that the detection device can discern between different objects or persons and identify a same object or person at different times, and wherein the detection device further comprises a means for determining a parameter that is connected to the evaluation unit and that delivers an additional signal, wherein the evaluation unit forms the characteristic parameter in dependance on the additional signal, wherein the parameter-determining means comprises a radiation source for radiation which can be detected by the sensor arrangement or alternatively or additionally to the radiation source comprises an additional sensor for detecting a person-individual signal; and a counter connected to the detection device; and wherein the detection device is adapted to be mounted above an entrance to the transportation vehicle.

2. The counting device of claim 1, wherein the individualising means forms the characteristic parameter from the morphology of the variation signal.

3. The counting device of claim 2, wherein the radiation source is an infrared light source which preferably emits radiation in the wavelength range of greater than 1400 nm.

4. The counting device of claim 3, wherein the evaluation unit is connected to the radiation source and the sensor arrangement determines, as an additional signal, the transit time of a signal which is emitted by the radiation source and reflected by the object or person and received by the sensor arrangement.

5. The counting device of claim 4, wherein the evaluation unit, is connected to the radiation source and the sensor arrangement and determines a degree of reflection as an additional signal.

6. The counting device of claim 5, wherein the radiation source emits a coded signal and wherein the evaluation unit determines the proportion of the coded signal in the radiation received by the sensor arrangement.

7. The counting device of claim 6, wherein the evaluation unit forms a degree of reflection from the ratio of the intensity of the proportion of the coded signal in the radiation received by the sensor arrangement to the intensity of the radiation emitted by the radiation source.

8. The counting device of claim 7, wherein the coded signal is a periodic signal and wherein the evaluation unit determines the transit time of a reflected signal in dependence on the phase relationship between a coded signal received by the sensor arrangement and a coded signal emitted by the radiation source.

9. The counting device of claim 8, wherein the sensor arrangement comprises at least two sensor elements and wherein the evaluation unit forms at least two variation signals for different sensor elements.

10. The counting device of claim 9, wherein the evaluation unit compares portions of one or more variation signals which were recorded at the same time as each other or in time-displaced relationship.

11. The counting device of claim 10, wherein the evaluation unit forms a correlation coefficient by comparing the variation signal portions.

12. The counting device of claim 11, wherein the evaluation unit implements a plurality of times comparison of signal portions originating from different sensor elements, in such a way that the signal portions for each comparison are shifted in time relative to each other by different time differences, and wherein a transit time signal is formed, which corresponds to that time displacement which affords the greatest similarity or best correlation of the signal portions being compared.

13. The counting device of claim 12, wherein the evaluation unit forms a speed signal from the transit time signal and from a predetermined spacing of those sensor elements at which the sign portions used for forming the transit time signal have their origin.

14. The counting device of claim 13, wherein a plurality of sensor elements are arranged matrix-like and wherein the evaluation unit compares signal portions originating from different sensor elements in mutually time-displaced relationship and derives a direction signal from the signal portion comparison operation, in such a way that a direction vector results from the spatial arrangement of those sensor elements which are associated with the signal portions of greatest similarity.

15. The counting device of claim 14, wherein the evaluation unit forms at least one parameter which describes a signal portion and stores said parameter in the store.

16. The counting device of claim 15, wherein the evaluation unit and the store are so connected and adapted that a signal portion and at least one parameter describing said signal portion can be stored in association with each other in the store.

17. The counting device of claim 16, wherein the evaluation unit detects the greatest amplitude of a signal portion as the parameter describing the signal portion and stores same in the store.

18. The counting device of claim 17, wherein the additional sensor detects hair color and delivers an additional signal which is dependent on hair color.

19. The counting device of claim 17, wherein the additional sensor is a microphone for detecting an acoustic signal and delivering an additional signal which is dependent on the acoustic signal.

20. The counting device of claim 17, wherein the additional sensor detects a scent signal and delivers an additional signal which is dependent on the scent signal.

21. The counting device of claim 2, wherein the evaluation unit is connected to the radiation source and the sensor arrangement and determines, as an additional signal, the transit time of a signal which is emitted by the radiation source and reflected by the object or person and received by the sensor arrangement.

22. The counting device of claim 21, wherein the evaluation unit is connected to the radiation source and the sensor arrangement and determines a degree of reflection as an additional signal.

23. The counting device of claim 22, wherein the radiation source emits a coded signal and wherein the evaluation unit determines the proportion of the coded signal in the radiation received by the sensor arrangement.

24. The counting device of claim 23, wherein the evaluation unit forms a degree of reflection from the ratio of the intensity of the proportion of the coded signal in the radiation received by the sensor arrangement to the intensity of the radiation emitted by the radiation source.

25. The counting device of claim 24, wherein the coded signal is a periodic signal and wherein the evaluation unit determines the transit time of a reflected signal in dependence on the phase relationship between a coded signal received by the sensor arrangement and a coded signal emitted by the radiation source.

26. The counting device of claim 25, wherein the sensor arrangement comprises at least two sensor elements and wherein the evaluation unit forms at least two variation signals for different sensor elements.

27. The counting device of claim 26, wherein the sensor arrangement comprises at least two sensor elements and wherein the evaluation unit forms at least two variation signals for different sensor elements.

28. The counting device of claim 27, wherein the evaluation unit forms a correlation coefficient by comparing the variation signal portions.

29. The counting device of claim 1, wherein the radiation source is an infrared light source which preferably emits radiation in the wavelength range of greater than 1400 nm.

30. The counting device of claim 1, wherein the evaluation unit is connected to the radiation source and the sensor arrangement and determines as an additional signal, the transit time of a signal which is emitted by the radiation source and reflected by the object or person and received by the sensor arrangement.

31. The counting device of claim 1, wherein the evaluation unit is connected to the radiation source and the sensor arrangement and determines a degree of reflection as an additional signal.

32. The counting device of claim 1, wherein the radiation source emits a coded signal and wherein the evaluation unit determines the proportion of the coded signal in the radiation received by the sensor arrangement.

33. The counting device of claim 32, wherein the evaluation unit forms a degree of reflection from the ratio of the intensity of the proportion of the coded signal in the radiation received by the sensor arrangement to the intensity of the radiation emitted by the radiation source.

34. The counting device of claim 33, wherein the coded signal is a periodic signal and wherein the evaluation unit determines the transit time of a reflected signal in dependence on the phase relation between a coded signal received by the sensor arrangement and a coded signal emitted by the radiation source.

35. The counting device of claim 34, wherein the sensor arrangement comprises at least two sensor elements and wherein the evaluation unit forms at least two variation signals for different sensor elements.

36. The counting device of claim 35, wherein the sensor arrangement comprises at least two sensor elements and wherein the evaluation unit forms at least two variation signals for different sensor elements.

37. The counting device of claim 36, wherein the evaluation unit forms a correlation coefficient by comparing the variation signal portions.

38. The counting device of claim 1, wherein the sensor arrangement comprises at least two sensor elements and wherein the evaluation unit forms at least two variation signals for different sensor elements.

39. The counting device of claim 1, wherein the evaluation unit compares portions of one or more variation signals which were recorded at the same time as each other or in time-displaced relationship.

40. The counting device of claim 39, wherein the evaluation unit forms a correlation coefficient by comparing the variation signal portions.

41. The counting device of claim 40, wherein the evaluation unit implements a plurality of times comparison of signal portions originating from different sensor elements, in such a way that the signal portions for each comparison are shifted in time relative to each other by different time differences, and wherein a transit time signal is formed, which corresponds to that time displacement which affords the greatest similarity or best correlation of the signal portions being compared.

42. The counting device of claim 41, wherein the evaluation unit forms a speed signal from the transit time signal and from a predeterminable spacing of those sensor elements at which the signal portions used for forming the transit time signal have their origin.

43. The counting device of claim 1, wherein a plurality of sensor elements are arranged matrix-like and wherein the evaluation unit compares signal portions originating from different sensor elements in mutually time-displaced relationship and derives a direction signal from the signal portion comparison operation, in such a way that a direction vector results from the spatial arrangement of those sensor elements which are associated with the signal portions of greatest similarity.

44. The counting device of claim 1, wherein the evaluation unit forms at least one parameter which describes a signal portion and stores said parameter in the store.

45. The counting device of claim 44, wherein the evaluation unit and the store are so connected and adapted that a signal portion and at least one parameter describing said signal portion can be stored in association with each other in the store.

46. The counting device of claim 45, wherein the evaluation unit detects the greatest amplitude of signal portion as the parameter describing the signal portion and stores same in the store.

47. The counting device of claim 46, wherein the additional sensor detects hair color and delivers an additional signal which is dependent on hair color.

48. The counting device of claim 46, wherein the additional sensor is a microphone for detecting an acoustic signal and delivering an additional signal which is dependent on the acoustic signal.

49. The counting device of claim 46, wherein the additional sensor detects a scent signal and delivers an additional signal which is dependent on the scent signal.

50. The counting device of claim 1, wherein the additional sensor detects hair color and delivers an additional signal which is dependent on hair color.

51. The counting device of claim 1, wherein the additional sensor is a microphone for detecting an acoustic signal and delivering an additional signal which is dependent on the acoustic signal.

52. The counting device of claim 1, wherein the additional sensor detects a scent signal and delivers an additional signal which is dependent on the scent signal.

53. An apparatus for detecting and counting passengers entering and exiting a transportation vehicle, said apparatus comprising:

a detection device comprising:

a source of radiation for transmitting electromagnetic energy at visible and/or infrared wavelengths into an area entered and/or exited by a plurality of persons over time;

a plurality of radiation sensor elements for detecting said transmitted electromagnetic energy reflected from each of said plurality of persons entering or exiting said area;

an evaluation unit connected to said source of radiation and said plurality of radiation sensor elements, and wherein said evaluation unit generates a three-dimensional contour pattern of each of said plurality of persons using said detected transmitted electromagnetic energy reflected from each of said plurality of persons and detected by said plurality of radiation sensor elements, and wherein said evaluation unit generates at least one time variation signal using said detected transmitted electromagnetic energy reflected from each of said plurality of persons and detected by at least two of said plurality of sensor elements, said wherein said evaluation unit associates said three-dimensional contour pattern with said time variation signal for each of said plurality of persons, and wherein said evaluation unit determines if each of said plurality of persons has entered or exited said area using said time variation signal for each of said plurality of persons; and a store unit to store each of said associated three-dimensional contour patterns and time variations signals; and a counter unit connected to said detection device to increment a count value when a person of said plurality of persons is determined to enter said area, and to decrement said count value when a person of said plurality of persons is determined to exit said area.

* * * * *